US006644361B2

(12) United States Patent
Otsubo

(10) Patent No.: US 6,644,361 B2
(45) Date of Patent: Nov. 11, 2003

(54) SUCTION NOZZLE OF COMPRESSION PRESERVATION BAG

(75) Inventor: Ryoichi Otsubo, Sakurai (JP)

(73) Assignee: Aru Corporation, Nara-ken (JP)

( * ) Notice: Subject to any disclaimer, the term of this patent is extended or adjusted under 35 U.S.C. 154(b) by 54 days.

(21) Appl. No.: 09/981,720

(22) Filed: Oct. 19, 2001

(65) Prior Publication Data

US 2002/0050303 A1 May 2, 2002

(30) Foreign Application Priority Data

Oct. 26, 2000 (JP) ..... 2000-007688

(51) Int. Cl.[7] ..... B65B 31/04
(52) U.S. Cl. ..... 141/65; 141/7
(58) Field of Search ..... 141/7, 8, 46, 65, 141/66, 114; 53/434, 512

(56) References Cited

U.S. PATENT DOCUMENTS 3,312,256 A * 4/1967 Reisinger ..... 141/65
3,648,740 A * 3/1972 Pruitt ..... 141/8
5,711,136 A * 1/1998 Carcano ..... 53/434

* cited by examiner

*Primary Examiner*—Gregory L. Huson
*Assistant Examiner*—Peter deVore
(74) *Attorney, Agent, or Firm*—Keating & Bennett LLP

(57) ABSTRACT

A suction nozzle for use in a compressive preservation bag that is made of air-impermeable synthetic resin material includes a check valve made of synthetic resin material at a portion thereof. The suction nozzle includes an elongated body having an insertion section that has a flattened, substantially cylindrical shape and is tapered so as to be inserted into the check valve. The insertion section of the body has a plurality of openings communicating with the inside of the body.

13 Claims, 6 Drawing Sheets

SUCTION NOZZLE OF COMPRESSION PRESERVATION BAG

BACKGROUND OF THE INVENTION

1. Field of the Invention

The present invention relates to a suction nozzle of a compressive preservation bag, and more particularly, to a suction nozzle of a compressive preservation bag, which is used for the compressive preservation bag capable of preserving an object such as futon, blanket, and thick cloths compactly by compressing them and which is mounted on a suction portion of a hose, a pipe or an extension pipe of a vacuum cleaner.

2. Description of the Prior Art

FIG. 6 shows a method of using a conventional compressive preservation bag for a futon and a suction nozzle that is used therewith. FIG. 6A is a perspective view showing the outline of the compressive preservation bag and the suction nozzle. FIG. 6B is perspective view showing the suction nozzle in use. As shown in FIG. 6A, after a folded object 2, such as futon or thick clothes, is inserted into a compressive preservation bag 1 from an opening 1*a,* the opening 1*a* is closed with a plastic fastener or other suitable closure. An open portion 3*a* of one check valve 3 of the compressive preservation bag 1 is closed via welding or other suitable closure device.

Then a suction nozzle 4 is inserted into the open portion 3*a* of the other check valve 3 of the compressive preservation bag 1. The suction nozzle 4 is cylindrical, has a circular cross-section, and is connected to a suction opening 5*a* of a hose of a vacuum cleaner 5. A suction auxiliary pipe 6 is mounted on the suction nozzle 4. In this state, the suction nozzle 4 is inserted into the open portion 3*a* of the other check valve 3 of the compressive preservation bag 1. The suction auxiliary pipe 6 is mounted on the suction nozzle 4 in such a manner that one end thereof is locked to the suction nozzle 4 and the other end thereof is projected outward from the check valve 3.

Then, air inside the compressive preservation bag 1 is removed with the vacuum cleaner 5 to depressurize the inside of the compressive preservation bag 1. Thereby, the compressive preservation bag 1 and the object accommodated therein are compressed. Then, the suction nozzle 4 is pulled out from the other check valve 3, and the open portion 3*a* thereof is closed via welding or other suitable closure device.

The suction nozzle 4 is cylindrical and has a circular cross-section, as shown in FIG. 6B. Thus, to insert the suction nozzle 4 into the open portion 3*a* of the check valve 3 of the compressive preservation bag 1 in an operation of compressively accommodating the object 2 by using the suction nozzle 4, it is necessary to diametrically press and spread the flat check valve 3. Thus, the check valve 3 is often wrinkled or cracked when the suction nozzle 4 is inserted therein. The damage generated on the check valve 3 allows air to leak from the compressive preservation bag 1 or outside air to flowing into the bag 1 during and after the compressive preservation work. Consequently, the object 2 is not completely compressed within the compressive preservation bag 1.

SUMMARY OF THE INVENTION

To overcome the above-described problems, preferred embodiments of the present invention provide a suction nozzle of a compressive preservation bag that prevents air leakage when the suction nozzle is inserted into the compressive preservation bag to compressively accommodate the object therein.

The suction nozzle of the compressive preservation bag of the present invention is made of air-impermeable synthetic resin material and includes a check valve made of synthetic resin material at a portion thereof, including an elongated body having an insertion section that has a flattened substantially cylindrical shape to be inserted into the check valve. The insertion section of the body is provided with a plurality of openings communicating with the inside of the body.

The check valve has an inner portion disposed inside the compressive preservation bag and an outer portion communicating with the inner portion and disposed outside the compressive preservation bag. The insertion section of the body includes a main-surface opening which has an approximately elliptical cross-section that tapers off toward a front end of the insertion section into a flattened substantially cylindrical shape, and communicates with the inside of the body through the two main surfaces of the insertion section, and a side opening communicating with the inside of the body, provided on both sides thereof such that the opening is disposed on both main surfaces of the insertion section.

The suction nozzle of a compressive preservation bag further includes a bifurcated open portion disposed at a front end of the insertion section of the body and communicating with the inside of the body. A plurality of the side openings, each having substantially circular arc shapes, and arranged in a longitudinal direction of both sides of the insertion section at desired intervals.

The suction nozzle of a compressive preservation bag further includes a suction auxiliary tool removably mounted on the main-surface opening. The suction auxiliary tool includes an elongated passage member having an open portion, and a locking member disposed at one end of the passage member in a longitudinal direction thereof and locking the passage member to the body of the suction nozzle such that the open portion is disposed adjacent to an outer wall of the body of the suction nozzle. When the insertion section of the body of the suction nozzle is inserted into the check valve, the locking member is locked to the open portion of the main-surface opening of the body of the suction nozzle such that other end of the passage member extends outside from the check valve.

The suction nozzle of a compressive preservation bag further includes a suction auxiliary tool fixed to the body of the suction nozzle by integral molding, assembly gluing, mechanical connection or other suitable connection mechanism. The suction auxiliary tool includes an elongated passage member having an open portion, and the open portion of the passage member is disposed adjacent an outer wall of the body of the suction nozzle such that the open portion of the passage member and an inside of the body of the suction nozzle communicate with each other. When the insertion section of the body of the suction nozzle is inserted into the check valve, the locking member is locked to the open portion of the main-surface opening of the body of the suction nozzle such that other end of the passage member extends outside from the check valve.

In the suction nozzle of the compressive preservation bag of preferred embodiments of the present invention, the insertion section of the body that is inserted into the check valve has a flattened substantially cylindrical shape. Thus, unlike the conventional suction nozzle, when inserting the suction nozzle into the check valve, it is unnecessary to press and spread the check valve. Accordingly, when inserting the suction nozzle into the check valve, there is no possibility that the suction nozzle will wrinkle the check valve or cause damage to the check valve, such as cracking. Thereby, the suction nozzle according to preferred embodiments of the present invention, prevents air from leaking from the compressive preservation bag and outside air from flowing into the compressive preservation bag during and after a compressive preservation work.

The suction nozzle includes a plurality of openings provided on the insertion section of the body of the suction nozzle. Therefore, the area of the compressive preservation bag to be sucked by the vacuum cleaner or other suction device is greatly increased. Thereby, the suction force of the suction nozzle is greatly increased, thus effectively removing the air from the compressive preservation bag. Where the object to be accommodated in the bag or the inner surface of the compressive preservation bag blocks any of the openings of the suction nozzle, the air inside the compressive preservation bag is still effectively sucked out through the other openings.

Where the suction nozzle includes the main-surface opening, the side opening, and the front-end opening provided on the insertion section of the body of the suction nozzle, the suction nozzle has a greatly increased suction area that greatly increases the suction force of the suction nozzle, thus effectively removing the air from the compressive preservation bag.

Where the suction auxiliary tool is removably locked to the body of the suction nozzle, the open portion of the locking member of the suction auxiliary tool is disposed adjacent to the outer wall of the body of the suction nozzle. Thus, an outside air-introducing ventilation passage is provided between the passage member and the outer wall of the body of the suction nozzle. Therefore, when the air inside the compressive preservation bag is removed with a vacuum cleaner or other suction device, with the suction auxiliary tool mounted on the body of the suction nozzle, the negative pressure inside the compressive preservation bag gradually increases. After the air inside the compressive preservation bag is removed, outside air is introduced into the body of the suction nozzle due to the action of the suction auxiliary tool. In this case, the outside air is sucked to and introduced into the body of the suction nozzle through the outside air-introducing ventilation passage provided between the passage member and the outer wall of the body of the suction nozzle. The amount of outside air introduced increases in proportion to the increase of the negative pressure inside the compressive preservation bag. Accordingly, an overload drive of the vacuum cleaner or other suction device is effectively prevented.

Where the suction auxiliary tool is fixed to the body of the suction nozzle by fixing means such as integral molding, assembly gluing, mechanical connection, the suction auxiliary tool operates in the same manner as the suction auxiliary tool that is removably mounted on the suction nozzle. The other end of the passage member in the longitudinal direction thereof extends outside from the check valve. Therefore, if the suction nozzle drops into the compressive preservation bag after termination of a compressive preservation of the object to be accommodated in the bag, the suction nozzle is easily removed from the compressive preservation bag through the extending portion of the passage member of the suction auxiliary tool.

The above and further elements, features, aspects, and advantages of the present invention will be more apparent from the following detailed description of preferred embodiments thereof with reference to the accompanying drawings.

BRIEF DESCRIPTION OF THE DRAWINGS

FIG. 6 shows a method of using a conventional compressive preservation bag for a futon and a suction nozzle which is used therefor and constitutes the background of the present invention, in which

DETAILED DESCRIPTION OF PREFERRED EMBODIMENTS

Figure 1:
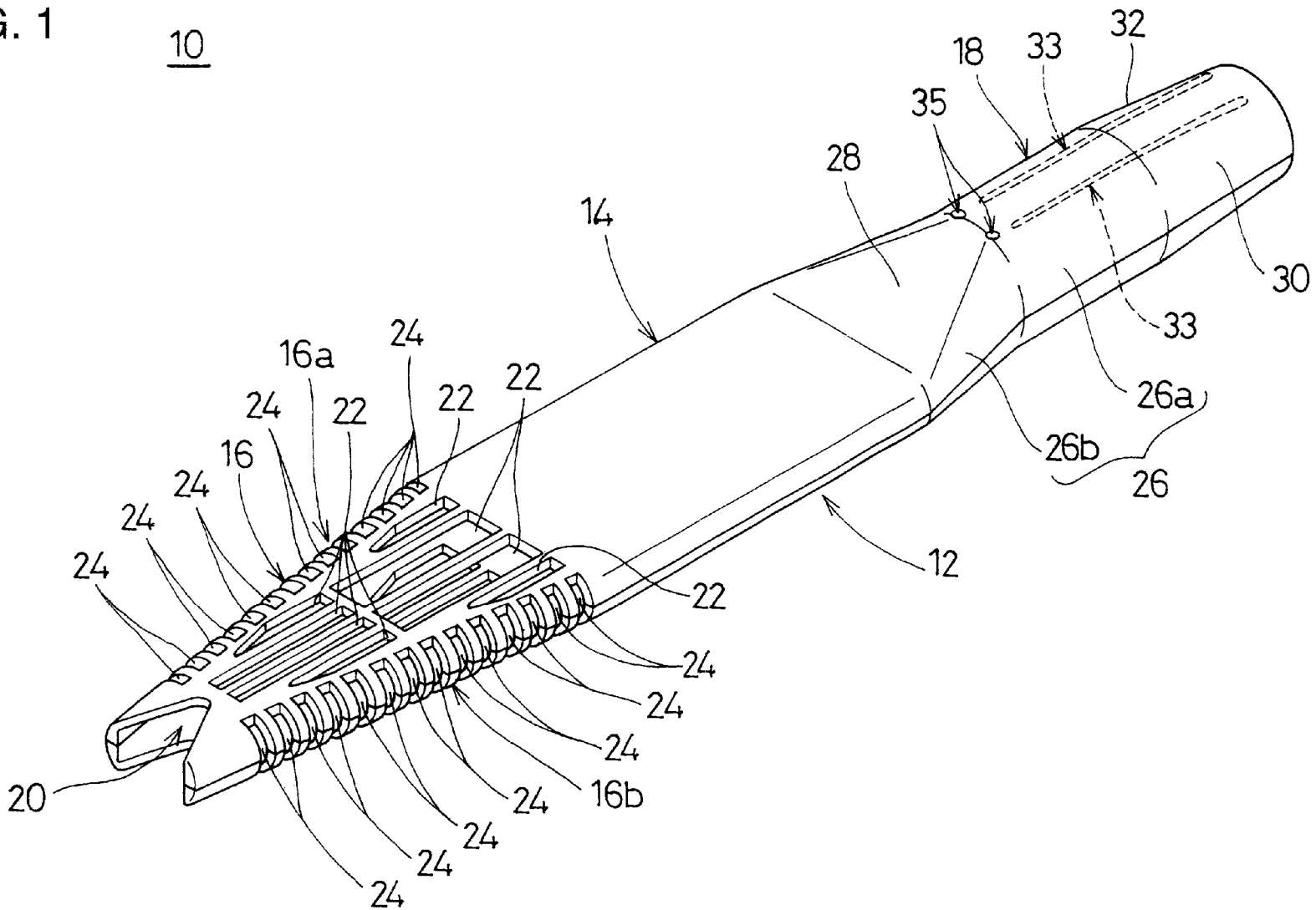
FIG. 1 is a perspective view showing a preferred embodiment of the present invention.
Figure 2:
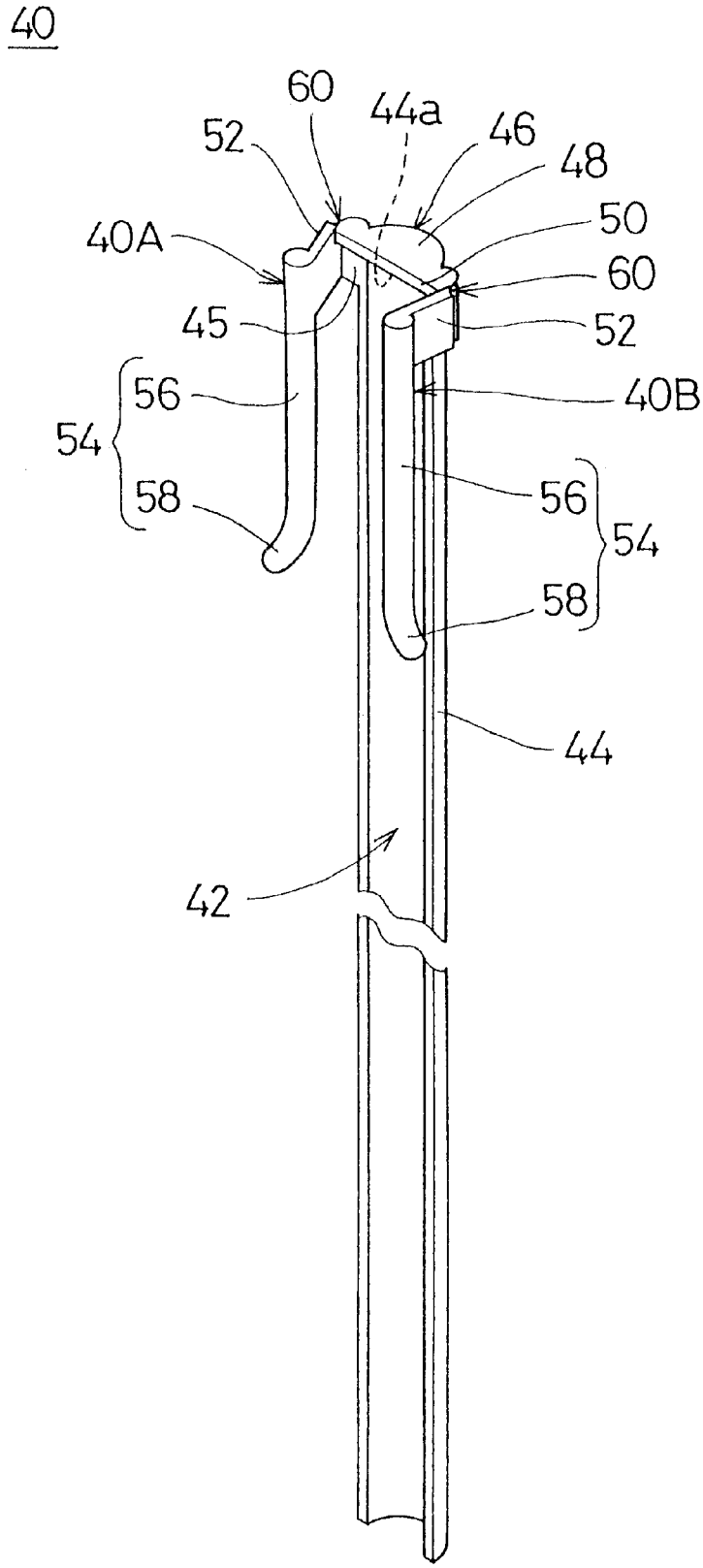
FIG. 2 is a perspective view showing an example of a suction auxiliary tool mounted on a suction nozzle.
Figure 3:
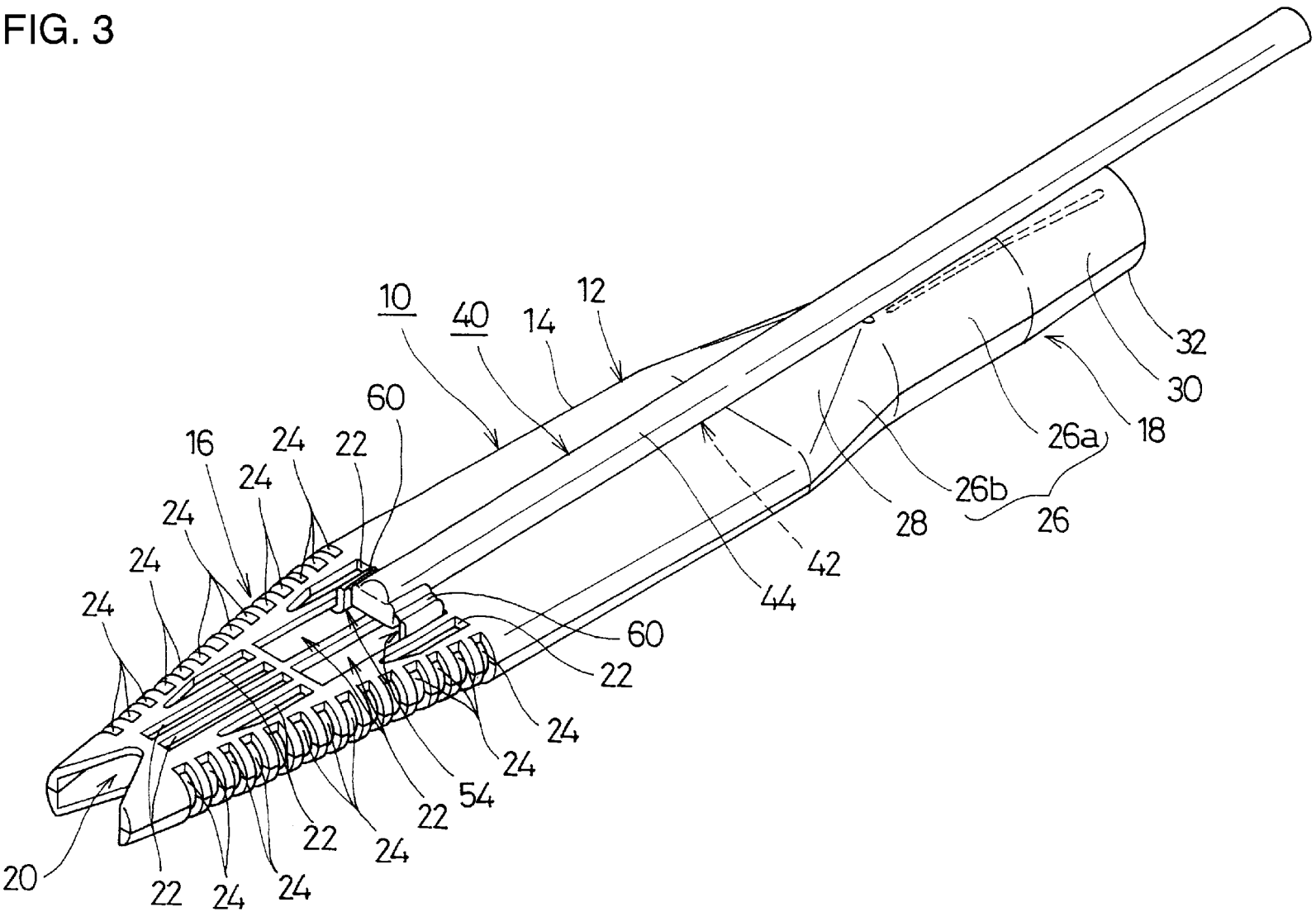
FIG. 3 is a perspective view showing a state in which the suction auxiliary tool of FIG. 2 is mounted on the suction nozzle of FIG. 1.
Figure 4:
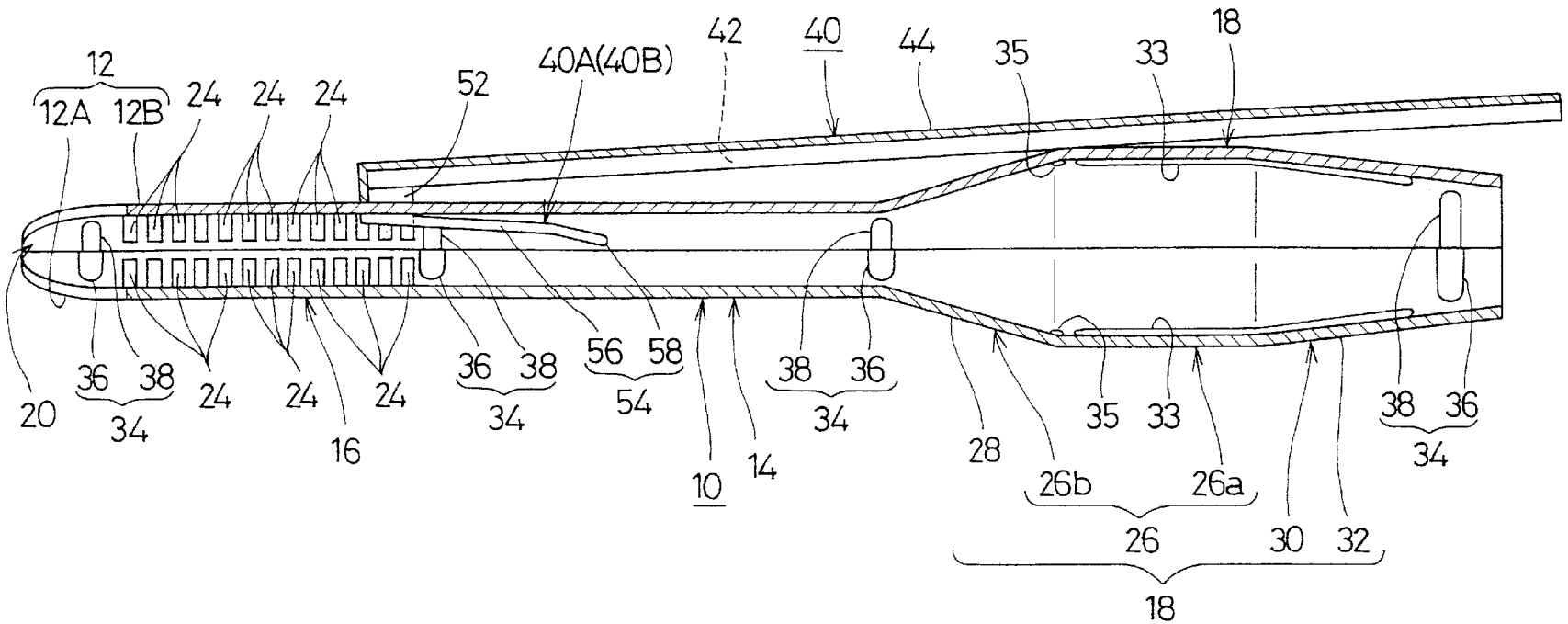
FIG. 4 is a sectional view showing a state in which the suction auxiliary tool of FIG. 2 is mounted on the suction nozzle of FIG. 1.

FIG. 1 is a perspective view showing a preferred embodiment of the present invention. FIG. 1 is a perspective view showing a preferred embodiment of the present invention. FIG. 2 is a perspective view showing an example of a suction auxiliary tool mounted on a suction nozzle. FIG. 3 is a perspective view showing a state in which the suction auxiliary tool of FIG. 2 is mounted on the suction nozzle of FIG. 1. FIG. 4 is a sectional view showing a state in which the suction auxiliary tool of FIG. 2 is mounted on the suction nozzle of FIG. 1.

The suction nozzle 10 of the present preferred embodiment includes an elongated body 12 having a flattened substantially cylindrical shape. The body 12 includes a flattened substantially cylindrical intermediate section 14 that is approximately elliptical in a cross-sectional view and approximately rectangular in a plan view. A tapering and flattened substantially cylindrical insertion section 16 to be accommodated inside a compressive preservation bag is provided at one side of the intermediate section 14 in its longitudinal direction. The body 12 is inserted into the compressive preservation bag through a check valve provided at a portion of the compressive preservation bag. A connection section 18 for connecting the body 12 to a suction device, such as a vacuum cleaner is disposed at the other side of the intermediate section 14 in its longitudinal direction. The connection section 18 is connected to a suction portion of a hose, a pipe or an extension pipe of the suction device.

The insertion section 16 of the body 12 of the suction nozzle 10 has a flattened substantially cylindrical shape such that it is approximately triangular in a plan view and approximately elliptical in a cross-sectional view. The insertion section 16 tapers off from its base, namely, the portion thereof continuous with one end of the intermediate section 14 to the front end of the insertion section 16 in its longitudinal direction. In this case, both sides 16*a* and 16*b* of the insertion section 16 confronting each other incline symmetrically.

A bifurcated open portion 20 communicating with the inside of the body 12 is provided at the front end of the insertion section 16 in its longitudinal direction. A plurality of main-surface openings 22 are provided on one main surface of the insertion section 16 and on the other main surface thereof at desired intervals. The main-surface openings 22 penetrate through the body 12 and communicate with the inside of the body 12. The insertion section 16 includes a plurality of side openings 24, communicating with the inside of the body 12, provided on both sides thereof such that the openings 24 are disposed on the one main surface of the insertion section 16 and on the other main surface thereof.

In the preferred embodiment, the plurality of the main-surface openings 22 are substantially rectangular in cross-section and penetrate through the insertion section 16 from the one main surface to the other main surface thereof. The side openings 24 are approximately circular-arc-shaped in cross-section, and are arranged in the longitudinal direction of both sides of the insertion section 16 at desired intervals such that the side openings 24 penetrate through the insertion section 16 from the one main surface to the other main surface thereof.

The connection section 18 of the body 12 includes a relay portion 26 having a substantially cylindrical portion 26*a* and an approximately truncated conical cylindrical portion 26*b*. The portion 26*b* includes an inclined surface 28 having two surfaces that incline symmetrically. The width of the inclined surface 28 gradually increases toward the portion at which the truncated conical portion 26*b* is continuous with the cylindrical portion 26*a*. One end of the relay portion 26 in its axial direction is continuous with the intermediate section 14. The other end of the relay portion 26 in its axial direction is continuous with a fitting portion 30 that is connected to a suction portion (not shown) of a suction mechanism of a vacuum cleaner or other suction device. The peripheral surface of the fitting portion 30 has a tapered portion 32 which tapers off from one end thereof. That is, tapered portion 32 tapers from the portion thereof continuous with the relay portion 26 to the other end thereof in its axial direction. Accordingly, connection of the fitting portion 30 of the connection section 18 to the suction portion of the hose, the pipe or the extension pipe of a vacuum cleaner is facilitated.

In the preferred embodiment, as shown in FIG. 4, the body 12 of the suction nozzle 10 is a split type. That is, the body 12 can be split into an upper portion 12A and a lower portion 12B. The upper portion 12A and the lower portion 12B are connected to each other by an engaging portion 34 having a joggle hole 36 and a joggle 38. More specifically, the upper portion 12A and the lower portion 12B are connected to each other by fitting the joggle 38 including a columnar projection into the substantially cylindrical joggle hole 36 to form the body 12. In the preferred embodiment, the body 12 includes the engaging portion 34 at four positions spaced at desired intervals in the longitudinal direction thereof. More specifically, the engaging portion 34 is disposed at the front end and rear end of the insertion section 16, the boundary between the intermediate section 14 and the connection section 18, and the other end of the fitting part 30 of the connection section 18.

With reference to FIGS. 1 and 4, a long and narrow groove 33 is provided on the upper and lower surfaces of the connection section 18. More specifically, the groove 33 extends from the relay portion 26 to the fitting portion 30. A hole 35 is provided at the boundary between the substantially cylindrical portion 26*a* and the truncated conical portion 26*b* of the relay portion 26. The hole 35 is used when the body 12 of the present preferred embodiment is preferably formed by molding a material.

The suction nozzle 10 of the present preferred embodiment includes a suction auxiliary tool 40 removably mounted on the main-surface opening 22. As best shown in FIG. 2, the suction auxiliary tool 40 includes an elongated passage member 44 having an open portion 3*a*. The passage member 44 is trough-shaped, and more particularly, substantially semicircular in section. A closing portion 46 is provided at an end 44*a* of the passage member 44 in the longitudinal direction thereof to close the end 44*a*. The closing portion 46 has a substantially semicircular closing plate 48 and a flange 50 that is continuous with the closing plate 48 and extending from one end surface of the passage member 44 to the other end surface thereof in its diametrical direction. The closing plate 48 and the flange 50 are preferably integral with each other.

The passage member 44 is substantially semicircular in the preferred embodiment, but may be circular arc-shaped. In addition, the passage member 44 may be polygonal. For example, the passage member 44 may be substantially square, substantially rectangular or other suitable shapes.

Locking members 40A and 40B for locking the passage member 44 to the outer wall of the body 12 are provided on the one end 44*a* of the passage member 44 in the longitudinal direction thereof. The locking members 40A and 40B are disposed at sides of the passage member 44 in its widthwise direction. In the preferred embodiment, the locking members 40A and 40B are disposed at sides of the closing portion 46 in its widthwise direction.

The locking members 40A and 40B preferably have the same construction, operation, and effect. Thus, the construction, operation, and effect of only the locking member 40A are described in detail below. The locking member 40A includes a substantially rectangular supporting portion 52 in a front view. One end of the supporting portion 52 in its widthwise direction is continuous with a flange 45 of the passage member 44. A rod-shaped locking arm 54 extending substantially parallel with the passage member 44 is provided at the other end of the supporting portion 52 in its widthwise direction.

The locking arm 54 includes a parallel arm 56 that is substantially parallel with the passage member 44 and spaced at a desired interval therefrom. A bent arm 58 that is continuous with the parallel arm 56 is provided at one end of the parallel arm 56 in its longitudinal direction. The interval between the bent arm 58 of the locking member 40A and the bent arm 58 of the locking member 40B is greater than the interval between the parallel arms 56 and the width of the passage member 44. The parallel arm 56 and the bent arm 58 are preferably integral with each other.

The supporting portion 52 supports the locking arm 54. A thin hinge 60 is concavely configured at the base of the supporting portion 52, namely, at the side of the flange 45 of the passage member 44 from the upper end of the supporting portion 52 to the lower end thereof. Due to the action of the hinge 60, the supporting portion 52 is bent toward the open portion 42 of the passage member 44. In the preferred embodiment, the passage member 44, the supporting portion 52, and the locking arm 54 are preferably integrally formed of a soft plastic material, such as polypropylene.

The locking arm 54 is inserted into and locked to the main-surface opening 22 provided on the insertion section 16 of the body 12 shown in FIG. 1 to thereby mount the suction auxiliary tool 40 on the suction nozzle 10. The locking arm 54 is inserted into one of the main-surface openings 22 such that the opening 42 confronts the outer wall of the body 12 of the suction nozzle. A ventilation passage for introducing outside air into the body 12 is provided between the open portion 42 of the passage member 44 and the outer wall of the body 12.

Figure 5:
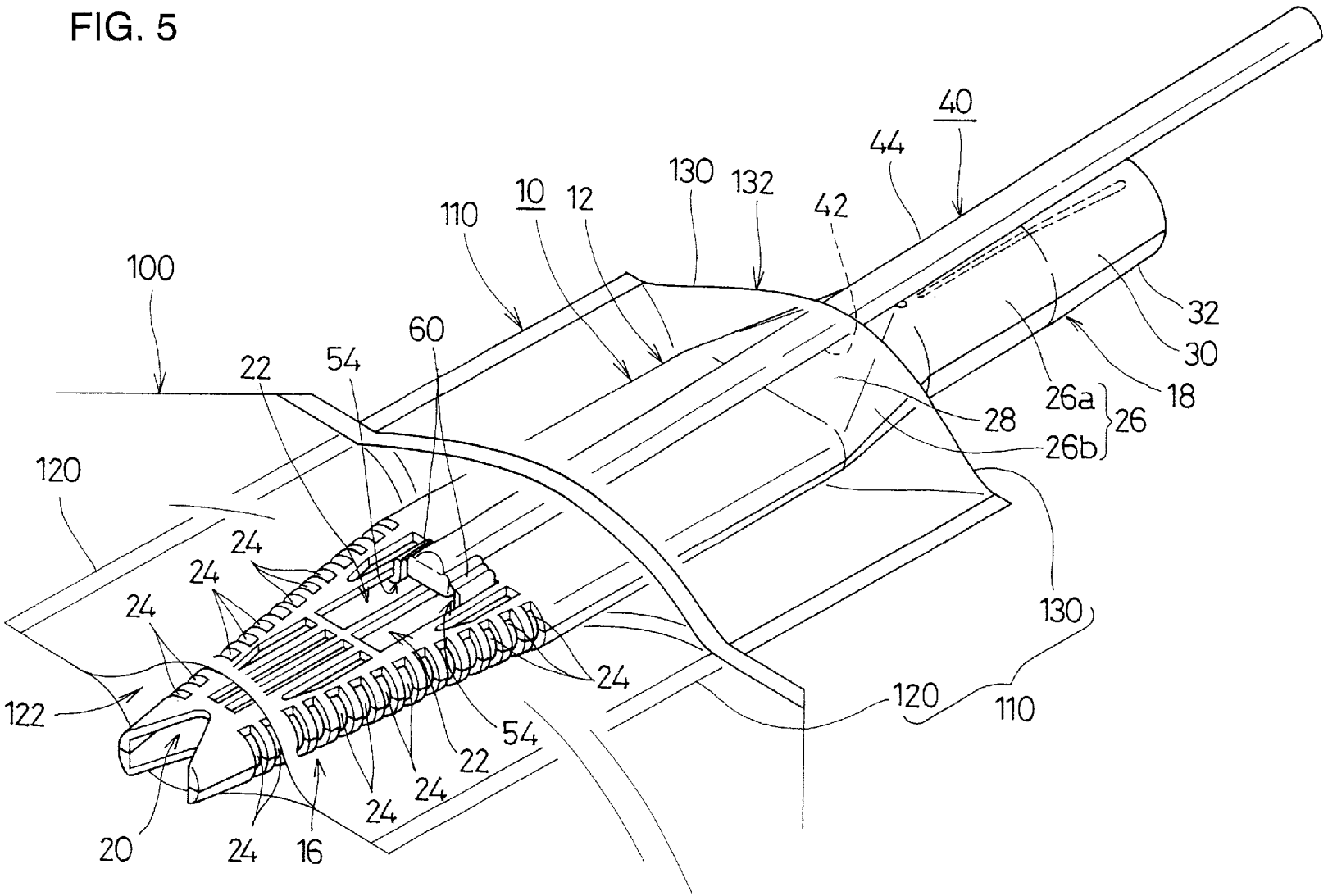
FIG. 5 is a perspective view showing a state in which the suction nozzle of FIG. 1 is used.
Figure 6A:
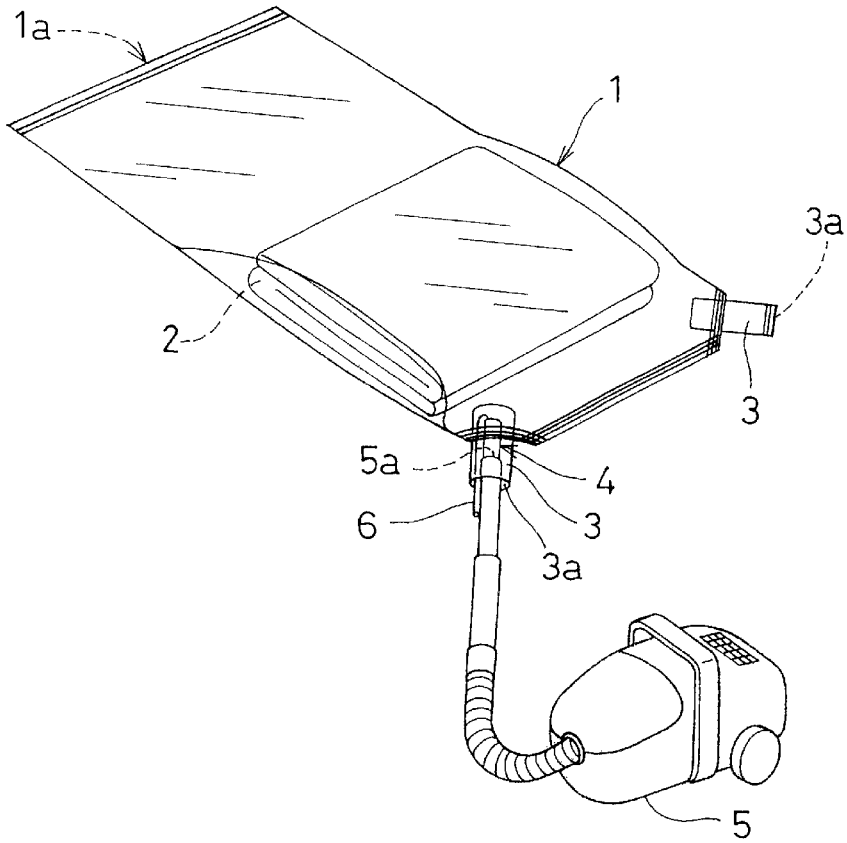
FIG. 6(A) PRIOR ART
FIG. 6A is a perspective view showing the outline of the compressive preservation bag and the suction nozzle.
Figure 6B:
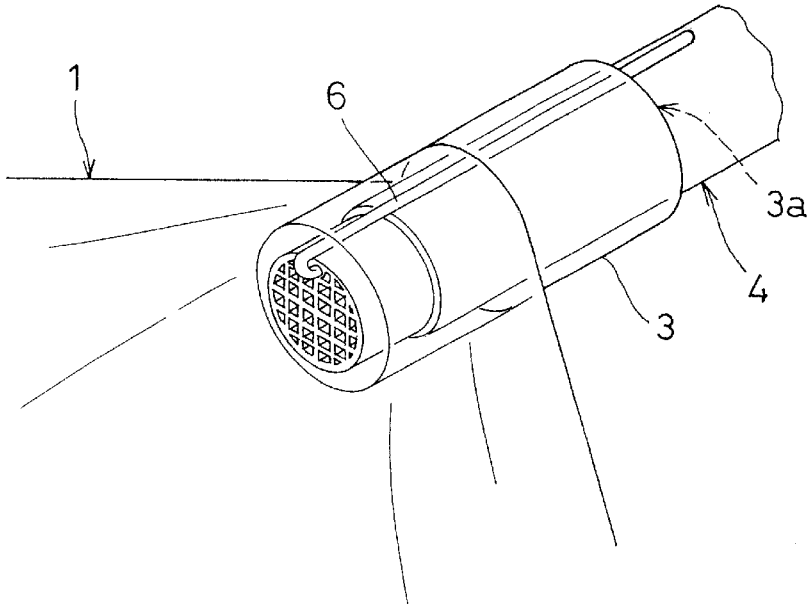
FIG. 6(B) PRIOR ART
FIG. 6B is a perspective view showing the use of the suction nozzle.

With reference to FIG. 5, the suction nozzle 10 of the compressive preservation bag of the present preferred embodiment of the present invention is preferably made of air-impermeable synthetic resin. The suction nozzle 10 is used with a compressive preservation bag 100 having a check valve 110 having a flattened substantially cylindrical shape and made of a synthetic resin material at a portion thereof. In the preferred embodiment, the compressive preservation bag 100 has a laminate structure having a plurality of air-impermeable plastic films laminated one upon another. The check valve 110 has an inner portion 120 disposed in the compressive preservation bag 100 and an outer portion 130 communicating with the inner portion 120 and disposed outside the compressive preservation bag 100.

As described above, the front end of the suction nozzle 10 is inserted into the compressive preservation bag 100 through the check valve 110, with the suction auxiliary tool 40 mounted on the body 12. In this case, the suction nozzle 10 is mounted on the check valve 110 such that the other end of the passage member 44 of the suction auxiliary tool 40 in the longitudinal direction of the passage member 44 extends and is exposed to the outside from the outer portion 130.

Air in the compressive preservation bag 100 is removed by a suction device such as a vacuum cleaner to depressurize the inside of the compressive preservation bag 100 to thereby force the inside of the compressive preservation bag 100 into a negative pressure state. At this time, because the inner surfaces of the inner portion 120 contact each other closely, an opening 122 of the inner portion 120 is closed As the negative-pressure inside the compressive preservation bag 100 increases due to suction, the entire compressive preservation bag 100 shrinks. As a result, the compressive preservation bag 100 and the to-be-accommodated object such, as a futon, are compressed. Thereafter, the suction nozzle 10 is removed from the check valve 110, and an opening 132 of the outer portion 130 is closed with a closing device such as welding and sealing with a plastic fastener. In this manner, the object to be accommodated inside the compressive preservation bag 100 is compressed and accommodated.

In the suction nozzle 10 for the compressive preservation bag of the present preferred embodiment, the insertion section 16 of the body 12 that is inserted into the check valve 110 has a flattened substantially cylindrical shape. Thus, when inserting the suction nozzle 10 into the check valve 110, it is unnecessary to press and spread the check valve 110. Accordingly, the suction nozzle 10 does not wrinkle the check valve 110 or cause damage to the check valve 110, such as cracking. Thereby, air is prevented from leaking from the compressive preservation bag 100 and outside air is prevented from flowing into the compressive preservation bag during and after a compressive preservation work.

The suction nozzle 10 for the compressive preservation bag of the present preferred embodiment has the main-surface opening 22, the side openings 24, and the front-end opening 20 provided on the insertion section 16 of the body 12. Therefore, the area of the compressive preservation bag to be sucked by the suction device is greatly increased. Thereby, the suction force of the suction nozzle is greatly increased, thus providing greatly improved removal of the air from the compressive preservation bag. When the object to be accommodated in the bag or the inner surface of the compressive preservation bag blocks any of the openings 20, 22, and 24, the air inside the compressive preservation bag is still effectively sucked through out the other openings 20, 22, and 24.

In the present preferred embodiment, because the suction auxiliary tool 40 is locked to the body 12 of the suction nozzle, the outside air-introducing ventilation passage is provided between the passage member 44 of the suction auxiliary tool 40 and the outer wall of the body 12. Thus, when the air inside the compressive preservation bag 100 is removed, the outside air is sucked and introduced into the body 12 through the ventilation passage. The introduction amount of the outside air increases in proportion to the increase of the negative pressure inside the compressive preservation bag. Accordingly, an overload drive of the suction device is prevented.

In the present preferred embodiment, although the suction auxiliary tool 40 is removably mounted on the body 12, the suction auxiliary tool 40 may be fixed to the body 12 by fixing mechanisms such as integral molding, assembly gluing, mechanical connection or other suitable fixing mechanisms.

That is, the suction auxiliary tool 40 includes the elongated passage member 44 having the open portion 42. The open portion 42 of the passage member 44 is disposed adjacent to the outer wall of the body 12 of the suction nozzle 10 such that the open portion 42 of the passage member 44 and the inside of the body 12 of the suction nozzle 10 communicate with each other. When the insertion section 16 of the body 12 of the suction nozzle 10 is inserted into the check valve 110, each of the locking member 40A and 40B is locked to the open portion 42 of the main-surface opening 22 of the body 12 of the suction nozzle 10 such that the other end of the passage member 44 extends out from the outer portion 130 of the check valve 110.

In this case, the suction auxiliary tool 40 fixedly mounted on the body 12 of the suction nozzle 10 has the same operation and effect as those of the suction auxiliary tool 40 that is removably mounted on the suction nozzle 10. Furthermore, the other end of the passage member 44 in the longitudinal direction thereof extends out from the outer portion 130 of the check valve 110. Therefore, when the suction nozzle 10 drops into the compressive preservation bag 100 after a compressive preservation of the object to be accommodated in the bag, the suction nozzle 10 is easily removed from the compressive preservation bag 100 through the extending portion of the passage member 44 of the suction auxiliary tool 40.

According to preferred embodiments of the present invention, when compressively accommodating the object in the compressive preservation bag using the suction nozzle 10, air is prevented from leaking out of the compressive preservation bag 100 and outside air is prevented from flowing into the compressive preservation bag 100. Thus, the object is effectively accommodated in the compressive preservation bag.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A suction nozzle, for use in a compressive preservation bag made of air-impermeable synthetic resin material and having a check valve made of synthetic resin material at a portion thereof, comprising:

an elongated body including an insertion section having a flattened substantially cylindrical shape and adapted to be inserted into said check valve;

wherein said insertion section of said body includes a plurality of openings communicating with an inside of said elongated body;

said check valve includes an inner portion disposed inside said compressive preservation bag and an outer portion communicating with said inner portion and disposed outside said compressive preservation bag; and said insertion section of said body includes at least one main-surface opening having an approximately elliptical cross-sectional shape that tapers off toward a front end of said insertion section, communicating with said inside of said body, and extending through said insertion section from one main surface and to another main surface thereof; and at least one side opening, communicating with said inside of said body, provided on both sides thereof such that said opening is disposed on said one main surface of said insertion section and said other main surface thereof.

2. A suction nozzle of a compressive preservation bag according to claim 1, further comprising a bifurcated open portion provided at a front end of said insertion section of said body and communicating with said inside of said body, wherein said at least one side opening includes a plurality of said side openings having a substantially circular arc shaped and arranged in a longitudinal direction of both sides of said insertion section at desired intervals.

3. A suction nozzle of a compressive preservation bag according to claim 1, further comprising a suction auxiliary tool removably mounted on said at least one main-surface opening, wherein said suction auxiliary tool includes an elongated passage member having an open portion, and a locking member disposed at one end of said passage member in a longitudinal direction thereof and locking said passage member to said body of said suction nozzle such that said open portion is disposed adjacent to an outer wall of said body of said suction nozzle;

when said insertion section of said body of said suction nozzle is inserted into said check valve, said locking member is locked to said open portion of said at least one main-surface opening of said body of said suction nozzle such that the other end of said passage member extends out from said check valve.

4. A suction nozzle of a compressive preservation bag according to claim 1, further comprising a suction auxiliary tool fixed to said body of said suction nozzle, wherein said suction auxiliary tool includes an elongated passage member having an open portion, and an open portion of said passage member is disposed adjacent to an outer wall of said body of said suction nozzle such that said open portion of said passage member and an inside of said body of said suction nozzle communicate with each other, when said insertion section of said body of said suction nozzle is inserted into said check valve, said locking member is locked to said open portion of said at least one main-surface opening of said body of said suction nozzle such that the other end of said passage member extends out from said check valve.

5. A suction nozzle of a compressive preservation bag according to claim 1, wherein said insertion section has a substantially triangular shape in plan view and an approximately elliptical cross-sectional shape.

6. A suction nozzle of a compressive preservation bag according to claim 1, wherein said at least one main-surface opening includes a plurality of main-surface openings extending through the insertion section from the one main surface to the other main surface thereof.

7. A suction nozzle of a compressive preservation bag according to claim 1, wherein said body includes a connection section including a relay portion having a substantially cylindrical portion and a truncated conical portion, one end of said relay portion being continuous with an end of said intermediate portion, and the other end of said relay portion being continuous with a fitting portion to be connected to a suction device.

8. A suction nozzle of a compressive preservation bag according to claim 7, wherein said connection portion includes a groove provided on an upper surface and a lower surface thereof.

9. A suction nozzle of a compressive preservation bag according to claim 8, wherein said groove extends from the relay portion to the fitting portion.

10. A suction nozzle of a compressive preservation bag according to claim 1, wherein said body includes an upper portion and a lower portion such that said upper portion and said lower portion are separable.

11. A suction nozzle of a compressive preservation bag according to claim 10, wherein said upper portion and said lower portion include engaging portions to connecting said upper portion to said lower portion.

12. A suction nozzle of a compressive preservation bag according to claim 11, wherein one of said engaging portions is defined by a joggle, and the other of said engaging portions is defined by a joggle hole.

13. A suction nozzle of a compressive preservation bag according to claim 11, wherein said upper portion includes four engaging portions, and said lower portion includes four engaging portions disposed to correspond to said four engaging portions of said upper portion.

* * * * *